US007677336B2

(12) United States Patent
Gent

(10) Patent No.: US 7,677,336 B2
(45) Date of Patent: Mar. 16, 2010

(54) PORTABLE DRILLING DEVICE

(76) Inventor: Brent J. Gent, 6152 Brinker St., SW., Navarre, OH (US) 44662

( * ) Notice: Subject to any disclaimer, the term of this patent is extended or adjusted under 35 U.S.C. 154(b) by 34 days.

(21) Appl. No.: 12/053,184

(22) Filed: Mar. 21, 2008

(65) Prior Publication Data

US 2008/0230276 A1 Sep. 25, 2008

Related U.S. Application Data

(60) Provisional application No. 60/896,344, filed on Mar. 22, 2007.

(51) Int. Cl.
*E02D 29/00* (2006.01)

(52) U.S. Cl. ..... 175/62; 175/323; 175/394; 405/132; 405/137

(58) Field of Classification Search ..... 175/18, 175/62, 113, 310, 323, 394, 112, 203; 405/132, 405/137; 475/331, 332; 37/270, 271
See application file for complete search history.

(56) References Cited

U.S. PATENT DOCUMENTS 2,201,088 A * 5/1940 Hamon ..... 414/552
2,890,860 A * 6/1959 Smith ..... 173/140
3,556,232 A * 1/1971 Koziski et al. ..... 175/88
4,199,033 A 4/1980 Van Gundy, Jr.
4,417,628 A 11/1983 Gessner
4,813,499 A 3/1989 McNulty
4,971,161 A * 11/1990 Godell ..... 175/18
4,998,590 A 3/1991 Wells
5,358,062 A * 10/1994 Uhl et al. ..... 175/394
5,507,354 A * 4/1996 Harleman ..... 175/162
6,076,617 A * 6/2000 Berner ..... 175/18
6,725,950 B2 * 4/2004 Palm ..... 175/162

OTHER PUBLICATIONS

Little Beaver Earth Drills & Augers, Accessories and Adapters, sales brochure, Jan. 2004, pp. 2-3, published at www.littlebeaver.com.

* cited by examiner

*Primary Examiner*—David J Bagnell
*Assistant Examiner*—Kipp C Wallace
(74) *Attorney, Agent, or Firm*—Krugliak, Wilkins, Griffiths & Dougherty Co., L.P.A.; Brent L. Moore

(57) ABSTRACT

A portable drilling device for use in horizontal boring through a substrate beneath an impediment includes a motor mounted on an inclined stabilizer bar. The inclined stabilizer bar includes a handle for use by the operator of the drilling unit which allows the operator to guide the unit during operation. A shaft is operatively mounted on the motor and is rotatably carried by the stabilizer bar. The shaft is in turn attached to an auger which is rotatably carried within a bearing housing assembly that is attached to the inclined stabilizer bar at a predetermined angle. A skid shoe is mounted underneath the shaft-auger attachment point and is attached to both the housing and the inclined stabilizer bar, whereby, when the motor is engaged the shaft and the auger are rotated in order to bore a horizontal opening through the substrate beneath an impediment such as a sidewalk or driveway.

8 Claims, 4 Drawing Sheets

PORTABLE DRILLING DEVICE

This application claims the benefit of U.S. Provisional Application No. 60/896,344, filed Mar. 22, 2007.

BACKGROUND OF THE INVENTION

1. Field of the Invention

The invention relates generally to the art of drilling devices, and in particular to portable drilling devices for use in boring horizontally through the soil beneath an impediment. More particularly, the invention relates to a drilling device for boring a horizontally-extending hole beneath an impediment, such as a cement slab, sidewalk or driveway, the presence of which makes direct vertical trenching impossible, in order to more easily lay pipes, electrical conduits and the like, beneath the impediment.

2. Background Art

Often times it becomes necessary to lay pipe, electrical conduits and the like, in the soil or substrate beneath an impediment, such as a driveway or a sidewalk. Typically, this is necessary when sprinkler systems, outdoor lighting, or other utility improvements such as security systems or landscape lighting are to be installed at locations where a sidewalk or driveway is already in place. Direct vertical trenching through the sidewalk or driveway in order to lay the pipe or conduit in the soil beneath the impediment would require that the sidewalk or driveway be broken apart, which adds additional costs and delays because the sidewalk or driveway must then be repaired after the pipe or conduit has been laid. Moreover, the sidewalk or driveway cannot be readily used during the time of trenching or during a usually extended period after the repair to the sidewalk or driveway is completed, because generally the repair of the sidewalk or driveway will need extended periods to set-up or cure so that normal use can be continued again.

Prior art methods and devices for horizontal drilling have generally been used in these types of situations. In one such prior art method, a trench is dug into the soil on both sides of the impediment, such as a sidewalk, and then a connection is made between the two trenches. This can be carried out by hand digging through the soil beneath the impediment, using picks and shovels; or by directing a stream of high pressure water at the soil beneath the impediment. This connection can also be carried out by utilizing a longitudinally extending blunt instrument, such as a pipe, that is driven through the soil beneath the sidewalk and which is then removed to leave a horizontally-extending hole through the soil beneath the sidewalk. This method can be particularly difficult because as the diameter of the blunt instrument increases, it becomes increasingly difficult to force or drive the instrument through the soil beneath the sidewalk or driveway. All of the aforementioned methods and devices for horizontal drilling are time consuming and involve a certain amount of difficulty. More particularly, in the case of the high pressure water technique, there is always the problem of drainage for or pump removal of the accumulated water, not to mention the possibility of erosion of the surrounding soil or substrate adjacent the bore which could result in a fracture or cave-in of the sidewalk which is above the horizontally-extending hole being drilled.

Still other more complicated prior art devices have been utilized in order to drill a horizontally-extending hole in the soil beneath an impediment. One such prior art device includes an auger that is mounted on a large vehicle, such as a skidsteer or tractor. This particular device is typically operated using hydraulics and, it is therefore, quite complex and expensive. Moreover, because it is typically mounted on a large vehicle, such as a skidsteer or tractor, it is difficult to use the device where space around the sidewalk or the driveway is limited, such as where the sidewalk is located in close proximity to an existing structure like a house or a barn. More particularly, where space is limited adjacent the impediment, it may be extremely difficult if not impossible to maneuver the skidsteer or tractor into position in order to horizontally drill beneath the impediment. Furthermore, because of the large size of the skidsteer or tractor, this particular device can also cause unnecessary damage to surrounding lawns and/or landscaping and the like. Because any damage to surrounding lawn and landscaping must be repaired in order to return the location to its prior condition, this particular drilling device adds unnecessary costs and expenses to the operation.

Yet still other prior art devices have been utilized in order to drill a horizontally-extending hole through the substrate beneath impediments. One such other prior art device includes an auger that is operatively connected to a wiggle-joint and a power source and is manufactured by Little Beaver, Inc. More particularly, this prior art device has a power source that is located on a small cart which is operatively connected to a hand-held auger that is held by the operator and which controls the rotation of the auger. More particularly, the handle/control is operatively connected to a drive shaft that is connected to a wiggle joint which is in turn operatively connected to an auger bit. The auger bit is typically about 5 feet in length. In order to operate this prior art drilling device, the operator is required to dig a six-foot long trench perpendicular to one side of the impediment along with a smaller trench directly opposite the long trench. The auger bit is then placed in the six-foot long trench and the power source is switched on. The power source rotates the drive shaft, wiggle-joint, and the auger bit, in order to drill horizontally below the impediment. As the auger bit is rotated, the operator pushes the device in the direction of the impediment in order to force the auger bit horizontally beneath the impediment. Once the small trench on the opposite side of the impediment is reached by the distal end of the auger bit, the operator then pulls the auger bit away from the impediment, leaving a horizontally-extending hole through the substrate beneath the impediment. This particular prior art device can be difficult to use because assembly of the various pieces of the device is required prior to operation. Moreover, because the power source is separate from the handle/control, it is difficult for the operator to maneuver and control the separate pieces of equipment while operating the device to drill the hole beneath the impediment. Furthermore, the handle/control, drive shaft, wiggle-joint and auger bit are also difficult to maneuver and control because they contain no additional support structure other than the components themselves, and therefore, are relatively unstable. In addition, it is difficult to move the device from one drilling location to another because the various components must be assembled and disassembled before and after each use, respectively.

Therefore, a need exists in the art for a portable drilling machine that is capable of boring a horizontal hole through the substrate beneath a sidewalk or driveway and which provides increased portability, stability and control over certain prior art devices, while reducing weight as well as costs associated with other prior art devices and which also reduces or minimizes time for assembling and disassembling the drilling device.

These improvements are provided by the portable drilling device of the present invention which increases portability, stability and control of the drilling device over prior art devices and which reduces weight and minimizes manufacturing and operating costs as well as reducing and/or minimizing assembly and disassembly times of the device over prior art devices.

SUMMARY OF THE INVENTION

The objectives of the present invention include providing a portable drilling device which reduces structural weight over prior art portable drilling devices.

Another objective of the present invention is to provide a portable drilling device which minimizes manufacturing costs as compared to prior art portable drilling devices.

Yet another objective of the present invention is to provide a portable drilling device which minimizes operating costs as compared to prior art portable drilling devices.

Even yet another objective of the present invention is to provide a portable drilling device which decreases assembly and disassembly times associated with prior art portable drilling devices.

Yet even a further objective of the present invention is to provide a portable drilling device which increases stability and control of the drilling device as compared to prior art portable drilling devices.

These objectives and advantages are obtained by the portable drilling device of the present invention which includes a motor mounted on an inclined stabilizer bar. The inclined stabilizer bar including a handle for use by an operator to guide the portable drilling device during operation of the drilling device. A shaft is operatively mounted on the motor, the shaft rotatably carried by the inclined stabilizer bar, the shaft attached to an auger, the auger rotatably carried by a housing assembly. The housing assembly attached to the inclined stabilizer bar at a predetermined angle, whereby when the motor is engaged, the shaft and the auger are rotated in a predetermined direction.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
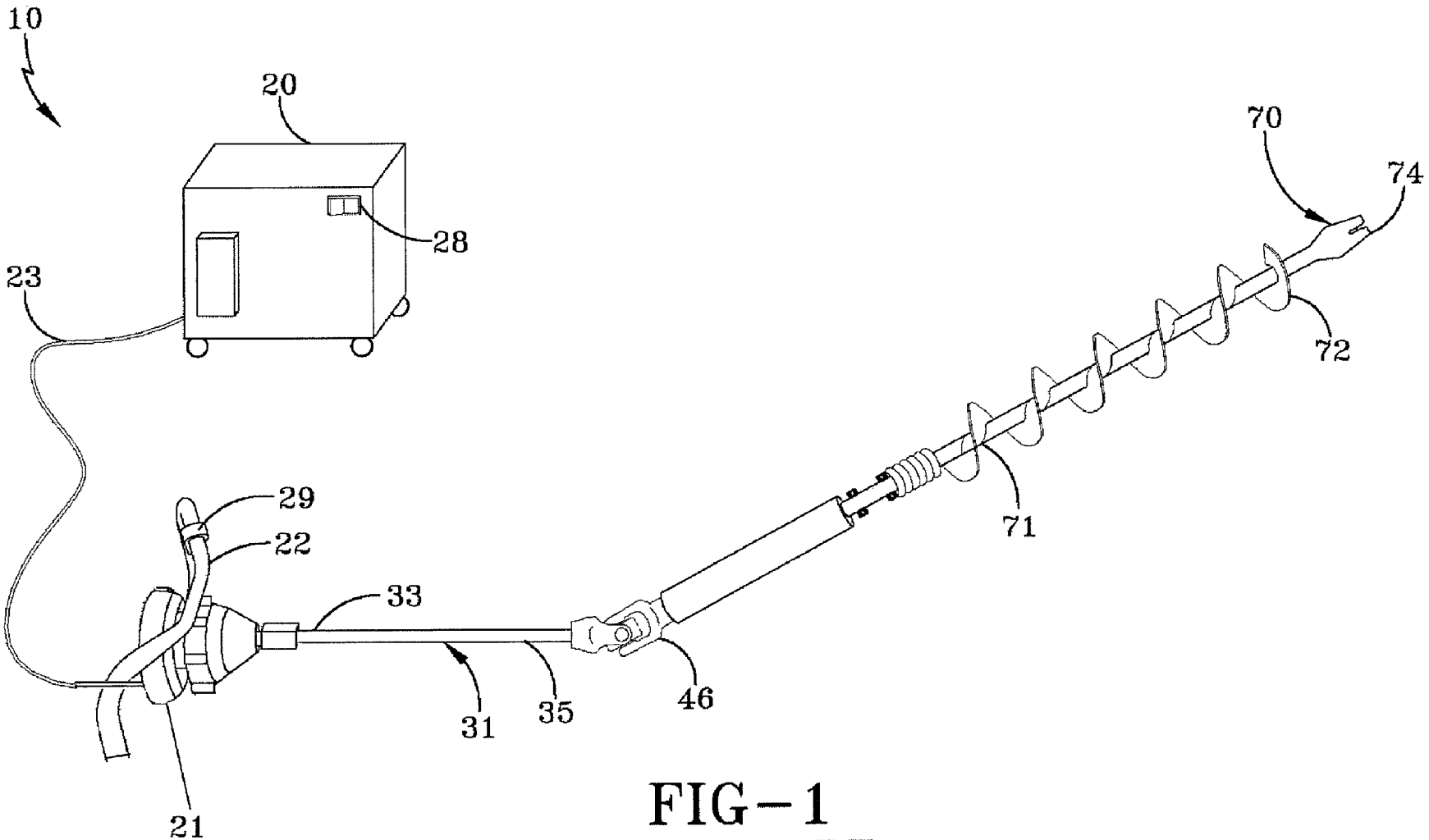
FIG-1 PRIOR ART
FIG. 1 is a diagrammatic view of a prior art portable drilling device, showing the power source, handle/control, drive shaft, wiggle joint and auger bit.
Figure 2:
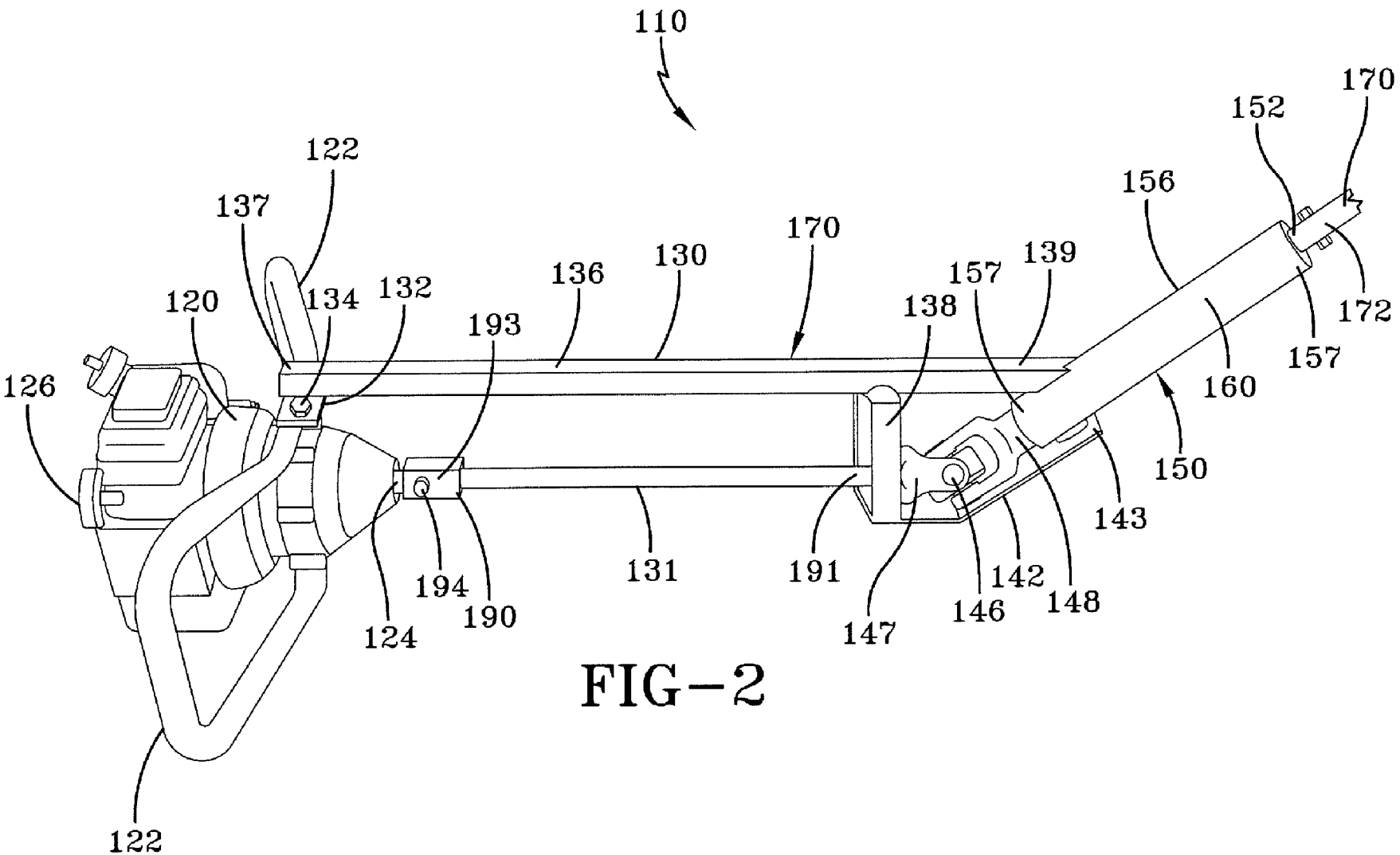
FIG. 2 is a perspective view of a portion of the portable drilling device of the present invention, showing the motor, inclined drive shaft, inclined stabilizer, skid shoe, universal joint and bearing assembly.
Figure 3:
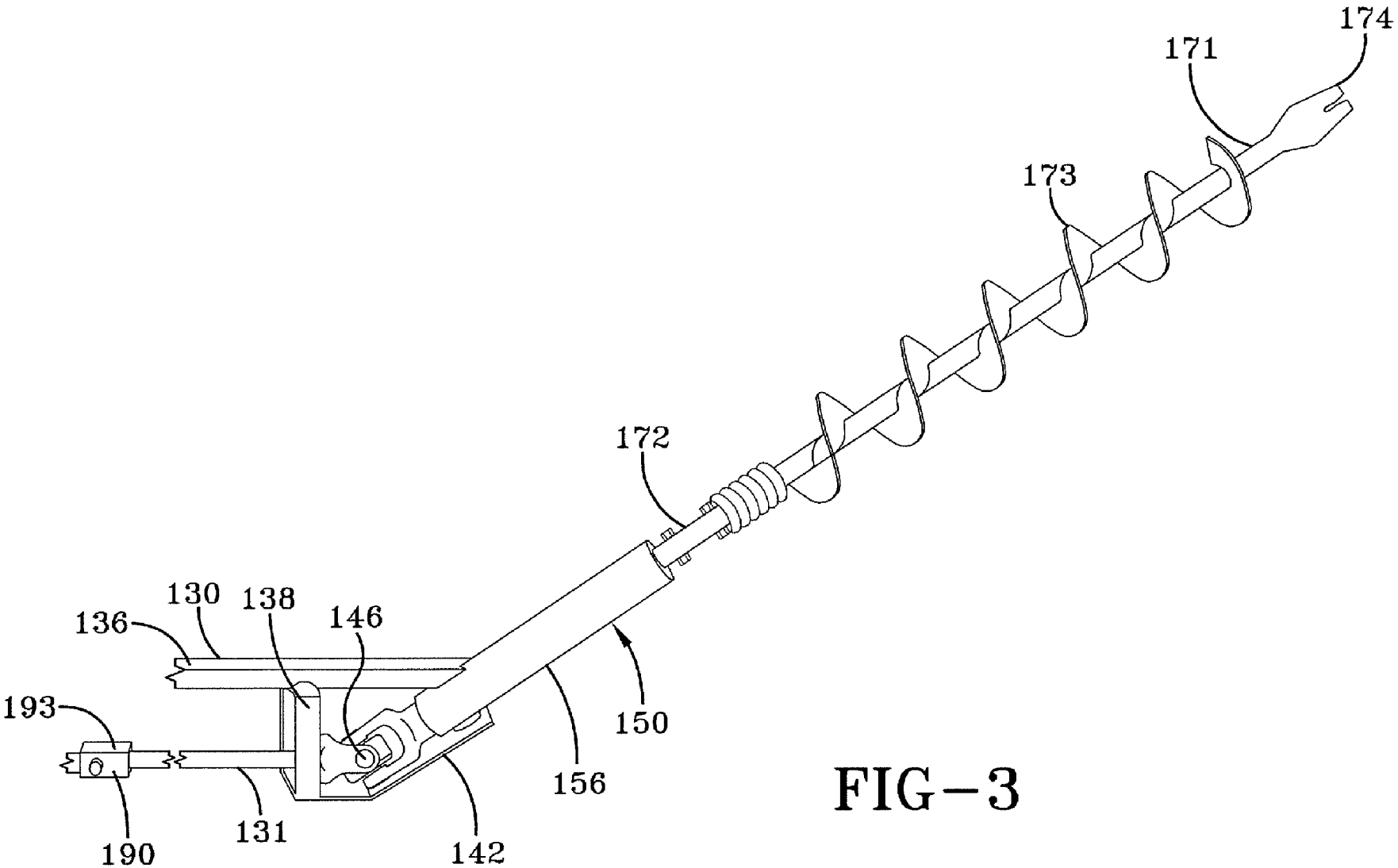
FIG. 3 is a perspective view of a portion of the portable drilling device shown in FIG. 2, showing the skid shoe, universal joint, bearing assembly and auger.
Figure 4:
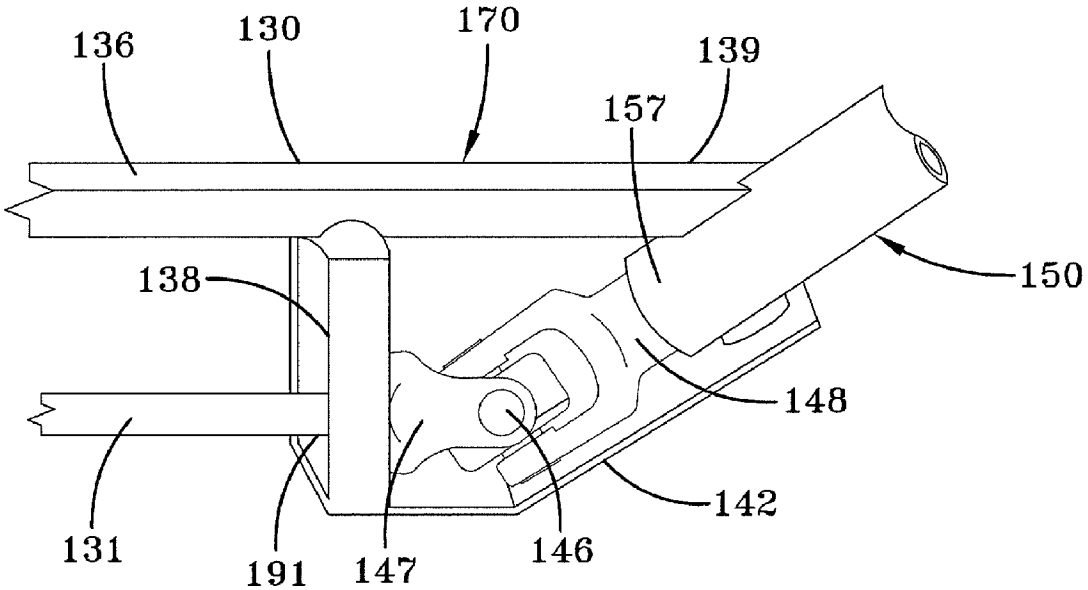
FIG. 4 is a greatly enlarged perspective view of a portion of the portable drilling device shown in FIG. 2, showing the universal joint and skid shoe and a portion of the inclined stabilizer and the inclined drive shaft.

In order to better understand the improved structure and function of the portable drilling device of the present invention, a prior art portable drilling device is shown in FIG. 1 and now will be described. Prior art portable drilling device 10 includes: a power source 20 operatively connected to a handle/control 21, which is connected to a drive shaft 31 that includes a wiggle joint 46 at its lower end which is connected to an auger bit 70.

More particularly, power source 20 of portable drilling device 10 of the prior art is a gasoline powered motor which is capable of producing rotational energy of the type well known to those skilled in the art and which is operatively connected to handle/control 21 via a conduit 23, whereby rotational energy produced in the power source is transmitted to the handle/control via the conduit. Power source 20 includes an ignition switch 28 which is utilized by an operator to activate the power source. When ignition switch 28 is moved by the operator to the "ON" position, power source 20 is turned on and rotational energy is produced. When ignition switch 28 is moved to the "OFF" position by the operator, power source 20 is turned off and no rotational energy is produced.

With continuing reference to FIG. 1, handle/control 21 includes a clutch or controller 29 for regulating the rotational energy imparted on the handle/control by the power source, via conduit 23. Handle/control 21 also includes two handles 22 mounted on the sides of the handle/control such that an operator using drilling device 10 can easily grasp the handles in order to maneuver the drilling device during operation of the device.

As set forth above, handle/control 21 is operatively connected to drive shaft 31. Drive shaft 31 is a generally cylindrical elongated metal bar having an upper end 33 and a lower end 35. More particularly, upper end 33 of drive shaft 31 is operatively connected to handle control 21 in a manner well known to those skilled in the art, such as a coupling (not shown), such that when the handle/control is engaged the drive shaft is rotated in a certain direction. Lower end 35 of drive shaft 31 includes an integral wiggle joint 46. More specifically, wiggle joint 46 is formed from steel and is a universal-type joint well known to those having skill in the art, which allows drive shaft 31 to wiggle angularly and yet still provide rotational energy to auger bit 70 to which it is connected. More particularly, wiggle joint 46 includes a coupling 48 at its distal end which is secured about an upper end 71 of auger bit 70 in a manner well known to those skilled in the art, such as a bolt. Auger bit 70 includes an upper end 71 and a lower end 72. Lower end 72 of auger bit 70 is formed into an auger tip 74.

In order to better understand the environment in which portable drilling device 10 of the prior art is typically utilized and also in order to better understand the function of the prior art portable drilling device, the environment and function of the prior art portable drilling device will now be described. As set forth above, prior art portable drilling device 10 is typically used to drill a horizontally-extending hole beneath an impediment such as a sidewalk or a driveway. Therefore, when an operator of portable drilling device 10 desires to make such an excavation, the operator must first assemble the components of the drilling device. As set forth above, those components include power source 20, conduit 23, handle/control 29, drive shaft 31 and auger bit 70. Once the operator has appropriately assembled the components, the operator then must dig a six foot long trench perpendicular to the impediment which the operator desires to drill beneath. A second smaller trench must also be dug on the other side of the impediment directly across from the first trench. Auger 70 then is placed in the long trench. The operator then moves power switch 28 on the power source to the "ON" position. Next, the operator grasps handles 22 of handle/control 21 and engages the control such that drive shaft 31 is rotated. The operator must now push or force handle/control 21, drive shaft 31 and auger 70 in the direction of the impediment. Once the hole has been drilled completely beneath the impediment, the operator can then pull drilling device 10 away from the impediment leaving a horizontally-extending hole beneath the impediment.

As set forth above, drilling device 10 of the prior art is difficult to assemble and is also difficult to maneuver and control because it has no stabilizers attached to drive shaft 31 and auger 70. Moreover, it is difficult to move the device from one drilling location to another because the various components must be assembled and disassembled before and after each use, respectively.

Turning now to FIGS. 2-5, a preferred embodiment of a portable drilling device of the present invention is indicated generally at 110 and will now be described. Portable drilling device 110 includes: a motor 120 operatively mounted on an auger assembly 170.

More particularly, auger assembly 170 includes a pair of generally U-shaped handles 122 attached to the upper distal end of the auger assembly. Handles 122 extend generally outwardly from auger assembly 170 such that an operator of drilling device 110 can easily grasp the handles in order to maneuver the drilling device during the drilling operation. Handles 122 are preferably made from a tubular steel or other such suitably robust material as is generally well known in the art, and could be fitted with a rubber grip (not shown) in order to allow the operator of portable drilling device 110 to obtain a better grip on the handles. Motor 120 is preferably a gasoline-powered engine such as a Model # E 43 Earthquake, manufactured by Xingtue Group Co. Ltd., however, other types of motors such as an electric motor or hydraulic-powered motor could be utilized without affecting the overall concept of the invention. Motor 120 preferably includes a shaft 124 which extends outwardly from the bottom of the motor such that when the motor is operated, the shaft is rotated in a predetermined direction. Motor 120 further includes an on/off switch (not shown) and a pull cord 126, for operating the motor. When on/off switch (not shown) is switched by the operator to the "ON" position and pull cord 126 is pulled outwardly from motor 120 by the operator, the motor is started in a manner well known to those skilled in the art. Motor 120 is mounted on auger assembly 170 by a drive bracket 132 and shaft 124 of the motor is connected to an inclined drive shaft 131 of the auger assembly.

More specifically, auger assembly 170 includes an inclined drive assembly 130 which is connected to a bearing assembly 150 which is in turn connected to an auger 174.

More particularly, inclined drive assembly 130 includes drive bracket 132, a skid shoe bracket 138, a skid shoe 142, a universal joint 146, an inclined stabilizer bar 136 and inclined drive shaft 131. Drive bracket 132 is a generally rectangular-shaped bracket made of steel or other suitable robust material which is attached to stabilizer bar 136 in a manner well known in the art, such as welding. Drive bracket 132 includes two openings (not shown) through which each of a pair of bolts 134 are disposed for attaching the drive bracket to motor 120. Inclined stabilizer bar 136 is a generally longitudinally-extending hollow steel tube having a square cross-sectional shape and also having a pair of ends 137 and 139. End 137 is attached to drive bracket 132, as set forth above. End 139 of inclined stabilizer bar 136 is attached to bearing assembly 150 at a generally 45° angle in a manner well known to those skilled in the art, such as welding. Skid shoe bracket 138, having a generally upside-down U configuration, is attached to inclined stabilizer bar 136 near end 139 and to skid shoe 142. More particularly, the upper-most surface of the upside-down U-shaped portion of skid shoe bracket 138 is attached to the lowermost surface of inclined stabilizer bar 136 in a manner well known to those skilled in the art, such as welding. Skid shoe bracket 138 is formed from steel or other suitable robust material. A lower portion of skid shoe bracket 138 is attached to a skid shoe 142 in a suitable manner, such as welding. Drive shaft 131 is a generally cylindrical solid steel shaft having a pair of upper and lower ends 190, 191, respectively. Upper end 190 includes an integral coupler 193 of the type well known to those having skill in the art. Upper end 190 of drive shaft 131 is connected to shaft 124 via integral coupler 193. More particularly, shaft 124 is inserted into coupler 193 and secured therein by bolt 194. Universal joint 146 is formed from steel and is a generally universal-type joint well known to those having skill in the art. Universal joint 146 has an upper coupler 147 which is connected to lower end 191 of drive shaft 131, by any suitable means, such as welding. Universal joint 146 also has a lower coupler 148 which is connected to a bearing shaft 152 of bearing assembly 150, by any suitable means, such as welding. Skid shoe 142 is formed from steel and has a generally flat rectangular-shape and includes a generally 45° bend near its transverse middle and includes an upper surface 143 and a lower surface 144. More particularly, upper surface 143 of skid shoe 142 is attached at its upper end to skid shoe bracket 138 and at its lower end to bearing assembly 150 in a manner well known to those skilled in the art, such as welding. Skid shoe 142 serves a fulcrum contact point with the ground for drilling device 110 and allows the drilling device to be more stable and more easily maneuvered by the operator during operation of the device.

Figure 5:
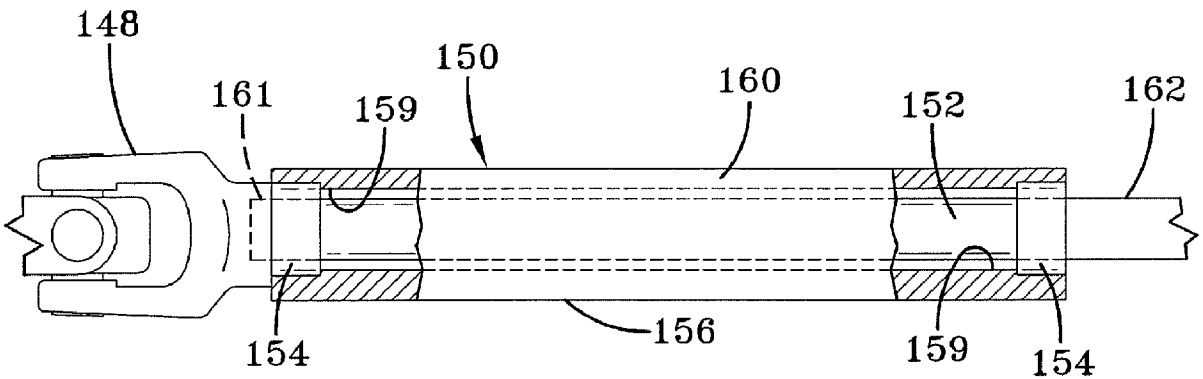
FIG. 5 is an enlarged elevational view of the bearing assembly and a portion of the universal joint assembly of the portable drilling device of the present invention with hidden lines, showing the lower end of the universal joint connected to the bearing assembly shaft disposed through the bearing assembly housing and bearings.

Turning now to FIG. 5, bearing assembly 150, which is attached to inclined drive assembly 130 as set forth above, includes bearing cylinder 156, bearing shaft 152 and a pair of bearings 154. Bearing cylinder 156 is an elongated cylinder formed from steel or other suitable robust material and includes a pair of ends 157, an inner diameter 159 and an outer surface 160. Each of bearings 154 are disposed into inner diameter 159 of bearing cylinder 156 at each end 157. Bearings 154 are typical ring-type bearings well known to those having skill in the art. Bearing shaft 152 is also disposed within bearing cylinder 156 and through each of bearings 154. Bearing shaft 152 includes a pair of ends 161,162, respectively. More particularly, end 161 of bearing shaft 152 is connected to lower end 148 of universal joint 146. End 162 of bearing shaft 152 is connected to an auger 170 in a manner well known to those having skill in the art, such as bolting or coupling.

Auger 170 is formed from steel or other suitably robust material and includes a pair of ends 171, 172. Upper end 172 of auger 170 is hollow for receipt of end 162 of bearing shaft 152. Auger 170 also preferably includes a spiraled flange 173 and a tip 174.

Having described the structure of portable drilling device 110 of the present invention, the operation of the invention will now be described. When the operator of portable drilling device 110 of the present invention desires to bore a hole underneath an impediment, such as a sidewalk or a driveway, the operator will first dig a small entrance hole next to the impediment. The operator will next move switch (not shown) 128 of motor 120 to the "ON" position and will pull cord 126 of motor 120 in order to start the motor. Once motor 120 has been started, the operator will place tip 174 of auger 170 into the entrance hole next to the impediment. The operator will then engage motor 120 so that shaft 124 of the motor is rotated in a certain direction. Because shaft 124 is fixedly attached to drive shaft 131, which is in turn fixedly attached to universal joint 146, which is in turn fixedly attached to bearing shaft 152, which is turn fixedly attached to auger 170, rotation of shaft 124 in a certain direction causes drive shaft 131, universal joint 146, bearing shaft 152 and auger 170 to also rotate in the same direction. By placing tip 174 of auger 170 into the hole next to the impediment and engaging motor 120 to rotate shaft 124, the tip and the auger are also rotated and the operator, by exerting pressure on portable drilling device 110 in the direction of the impediment, will cause the auger to bore underneath the impediment. Once the operator is able to see auger 170 has passed completely under the impediment by viewing tip 174 through the second small hole on the opposite side of the impediment, portable drilling device 110 can then be removed by the operator leaving a horizontal hole underneath the impediment. The operator can then easily feed pipes or conduits through the hole as needed.

With respect to portable drilling device 110 of the present invention, this improved drilling device optimizes portability, maneuverability, stability and control over drilling devices of the prior art. Portable drilling device 110 also reduces weight and size over prior art drilling devices and also reduces assembly times needed for set-up associated with other portable-type prior art drilling devices.

The present invention has been described with reference to a specific embodiment. It is to be understood that this illustration is by way of example and not by way of limitation. Potential modifications and alterations will occur to others upon a reading and understanding of this disclosure, and it is understood that the invention includes all such modifications and alterations and equivalents thereof.

Accordingly, the improved portable drilling device of the present invention is simplified, provides an effective, safe, inexpensive, and efficient portable drilling device which achieves all the enumerated objectives, provides for eliminating difficulties encountered with prior art portable drilling devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved portable drilling device is constructed, arranged and used, the characteristics of the construction and arrangement, and the advantageous, new and useful results obtained; the new and useful structures, devices, elements, arrangements, parts and combinations, and methods are set forth in the appended claims.

What is claimed is:

1. A portable drilling device for drilling horizontally below the surface of the ground comprising;

a) a motor being mounted on an inclined stabilizer bar;

b) said inclined stabilizer bar including a handle for use by an operator to guide said portable drilling device during operation of the drilling device;

c) a shaft being operatively mounted on said motor, said shaft rotatably carried by said inclined stabilizer bar, the shaft attached to an auger, said auger rotatably carried by a housing assembly, said housing assembly attached to said inclined stabilizer bar at a predetermined angle, whereby when said motor is engaged, said shaft and said auger are rotated in a predetermined direction to drill horizontally below the surface of the ground.

2. The portable drilling device of claim 1, further comprising a universal joint being disposed between said shaft and said auger.

3. The portable drilling device of claim 2, further comprising a skid shoe attached to said housing assembly and said inclined stabilizer bar generally beneath said universal joint.

4. The portable drilling device of claim 1, said housing assembly further comprising a pair of bearings, said auger rotatably mounted on said bearings.

5. The portable drilling device of claim 1, said auger further comprising a raised helical ridge.

6. The portable drilling device of claim 3, said predetermined angle being from about 35 degrees to about 45 degrees.

7. A portable drilling device for drilling horizontally below the surface of the ground, comprising;

a) an inclined stabilizer bar, said inclined stabilizer bar including a first end and a second end;

b) a motor and a handle being mounted on said first end of said inclined stabilizer bar, said handle being used by an operator to guide said portable drilling device during operation of the drilling device;

c) a shaft being operatively connected to said motor, said shaft being attached to an auger, said auger rotatably carried by a housing assembly, said housing assembly attached to said second end of said inclined stabilizer bar at a predetermined angle, whereby when said motor is engaged, said shaft and said auger are rotated in a predetermined direction to drill horizontally below the surface of the ground.

8. A portable drilling device for drilling horizontally below the surface of the ground, comprising;

a) an inclined stabilizer bar, said inclined stabilizer bar including a first end and a second end;

b) a motor and a handle being mounted on said first end of said inclined stabilizer bar, said handle being used by an operator to guide said portable drilling device during operation of the drilling device;

c) a shaft being operatively connected to said motor, said shaft attached to an auger at a predetermined angle by a universal joint which is disposed between said shaft and said auger, said auger rotatably carried by a housing assembly, said housing assembly attached to said second end of said inclined stabilizer bar, whereby when said motor is engaged, said shaft and said auger are rotated in a predetermined direction to drill horizontally below the surface of the ground.

* * * * *